US008411892B2

(12) United States Patent
Grundland et al.

(10) Patent No.: US 8,411,892 B2
(45) Date of Patent: Apr. 2, 2013

(54) AESTHETIC LINEAR SPEAKER ASSEMBLY

(76) Inventors: Norberto Grundland, Davie, FL (US); Evenecer Garcia, Southwest Ranches, FL (US)

( * ) Notice: Subject to any disclaimer, the term of this patent is extended or adjusted under 35 U.S.C. 154(b) by 157 days.

(21) Appl. No.: 13/099,620

(22) Filed: May 3, 2011

(65) Prior Publication Data

US 2012/0106771 A1 May 3, 2012

Related U.S. Application Data

(60) Provisional application No. 61/330,474, filed on May 3, 2010.

(51) Int. Cl.
*H04R 1/20* (2006.01)
*H04R 5/02* (2006.01)
*H04R 9/06* (2006.01)

(52) U.S. Cl. ..... 381/343; 381/301; 381/334; 381/335; 381/388

(58) Field of Classification Search ..... 381/301, 381/334–335, 343, 388
See application file for complete search history.

(56) References Cited

U.S. PATENT DOCUMENTS

| | | | | |
|---|---|---|---|---|
| 2,511,917 A | | 6/1950 | Hornor | |
| 4,344,504 A | | 8/1982 | Howze | |
| 5,163,167 A | | 11/1992 | Heil | |
| 5,995,634 A | * | 11/1999 | Zwolski | 381/160 |
| 6,112,847 A | | 9/2000 | Lehman | |
| D547,297 S | | 7/2007 | Nakamura | |
| 2003/0127280 A1 | | 7/2003 | Engebretson | |
| 2003/0219139 A1 | * | 11/2003 | Baird et al. | 381/343 |
| 2005/0091739 A1 | | 5/2005 | Lerma | |
| 2006/0151237 A1 | | 7/2006 | Oxford et al. | |

FOREIGN PATENT DOCUMENTS

| | | | |
|---|---|---|---|
| DE | 202010000602 U1 | | 5/2010 |
| JP | 2007-067959 | | 3/2007 |
| WO | WO 96/28949 | | 9/1996 |
| WO | WO2007026648 | * | 3/2007 |

* cited by examiner

*Primary Examiner* — Brian Ensey
*Assistant Examiner* — Katherine Faley
(74) *Attorney, Agent, or Firm* — Robert M. Schwartz

(57) ABSTRACT

A linear speaker assembly including a plurality of speakers in side by side relation within a piece of furniture in such a manner that a horn element, a phase plug and other ancillary speaker structure forms a sound path that communicates from the speakers to the environment and the speaker assembly is partially concealed or camouflaged from the casual viewing of an observer. The phase plug and horn element are elongated and are provided along the entire length of the plurality of speakers which comprise a portion of the linear speaker assembly. The phase plug and horn element visually complement the outer portion of the piece of furniture that the plurality of speakers are disposed within. This permits the piece of furniture or other structure to provide amplified sound from a plurality of speakers in side by side relation in such a manner whereby the speaker assembly is substantially camouflaged or not visible.

14 Claims, 6 Drawing Sheets

VIEW A-A OF FIG.1

SECTION B-B OF FIG.1

SECTION C-C OF FIG.1

AESTHETIC LINEAR SPEAKER ASSEMBLY

INDEX TO RELATED APPLICATIONS

This application claims benefit from U.S. Provisional Application No. 61/330,474 filed May 3, 2010, the disclosure of which is incorporated herein by reference in its entirety.

BACKGROUND OF THE INVENTION

Speaker systems when not housed are conspicuous and take up space. There are many instances when it is desirable to camouflage, hide and reduce the visibility of speakers without the loss of sound quality, fidelity, stereo, surround-sound and other sound and sound quality characteristics positively associated with speaker systems.

FIELD OF THE INVENTION

The invention relates to a linear speaker assembly where a single elongated phase plug is employed over a plurality of speakers. The speakers are in a linear arrangement and may be single, multiple or in modules, but however deployed in the line, they share a unitary, linear, elongated phase plug. Generally speaking, a phase plug is a device inside a compression driver that ensures that the sound from the diaphragm of a speaker has an equal path length to the throat of the horn from all areas of the diaphragm, this prevents cancellation and extends high frequency response. Additionally, the outer elements of the linear speaker assembly, including the phase plug are such that they blend in with or are actually an integral part of a housing in which the linear speaker assembly is enclosed. This may be done in an aesthetically pleasing manner.

SUMMARY OF THE INVENTION

The invention relates to speakers which are housed in an enclosure. An example of such an enclosure includes, but is not limited to, moldings, frames, television housings, computer screen housings, radios, linear handles, cabinets and any and all other types of furniture. The invention specifically is concerned with the arrangement of the speaker, driver, throat, horn, phase plugs and other elements of the linear speaker assembly. In the case of a piece of furniture for instance, the instant invention would be employed generally as the following.

A linear speaker assembly including a plurality of speakers in side by side relation within a piece of furniture in such a manner that a horn element, a phase plug and other ancillary speaker structure forms a sound path that communicates from the speakers to the environment and the speaker assembly is partially concealed or camouflaged from the casual viewing of an observer. The phase plug and horn element are elongated and are provided along the entire length of the plurality of speakers which comprise a portion of the linear speaker assembly. The phase plug and horn element visually complement the outer portion of the piece of furniture that the plurality of speakers are disposed within. This permits the piece of furniture or other structure to provide amplified sound from a plurality of speakers in side by side relation in such a manner whereby the speaker assembly is substantially camouflaged or not visible.

BRIEF DESCRIPTION OF THE DRAWINGS

For a more thorough understanding of the present invention, reference should be made to the following detailed description taken in conjunction with the following drawing figures wherein.

DETAILED DESCRIPTION OF THE DRAWINGS

Figure 1:
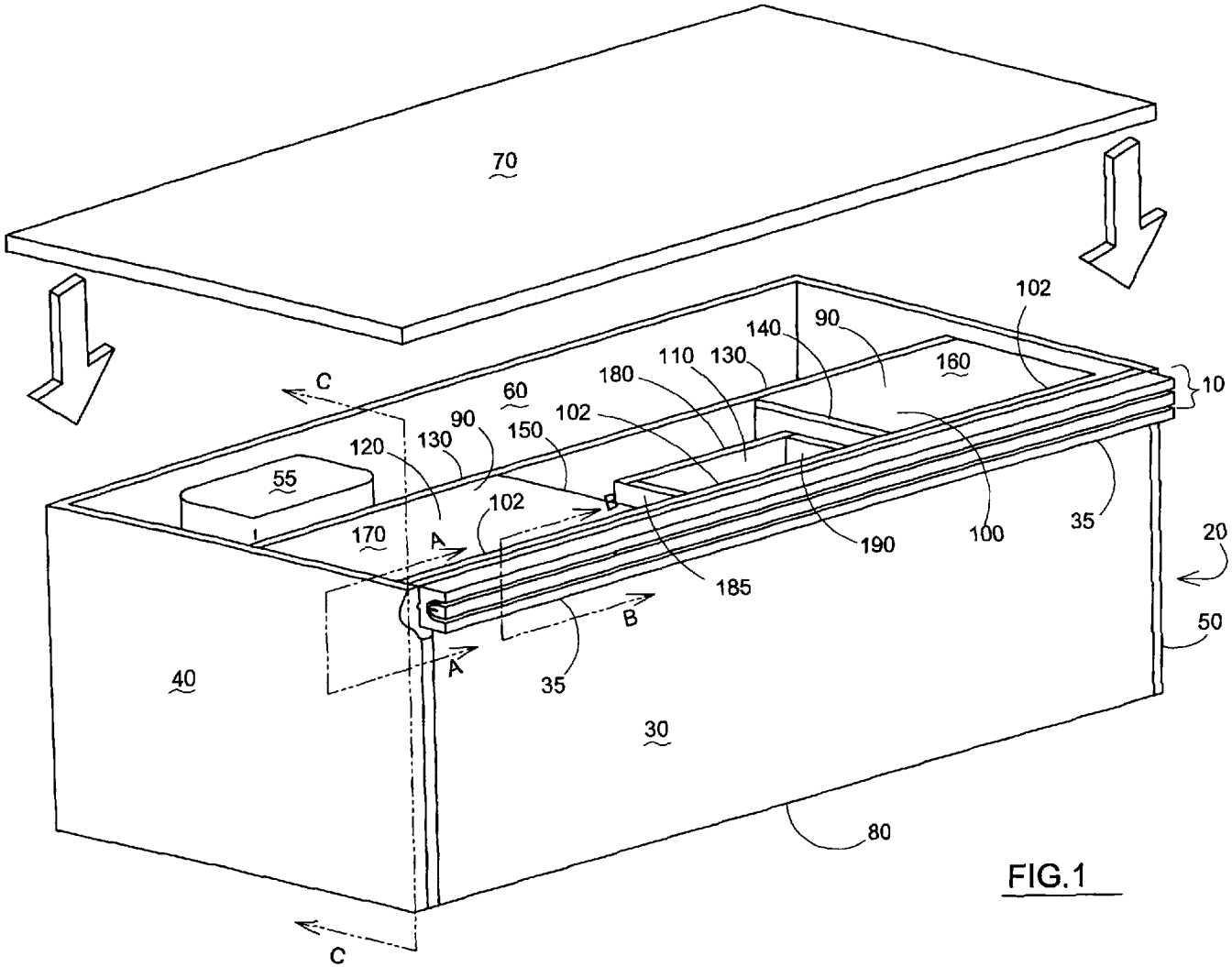
FIG. 1 is a partially exploded view of the aesthetic linear speaker assembly of the invention.

Referring now to FIG. 1 a partially exploded view of the aesthetic linear speaker assembly 10 shown within a generic piece of furniture 20 or the like is shown. The generic piece of furniture 20 includes a front sidewall 30, a front sidewall upper portion 35, a left sidewall 40, a right sidewall 50, a rear sidewall 60, a top side wall 70 and a bottom sidewall 80. The generic piece of furniture 20 also includes a linear speaker assembly mounting means generally designated by 90. The linear speaker assembly 10 includes three modules in this embodiment, a right module 100, a central module 110 and a left module 120. All three modules 100, 110, and 120 include a linear speaker assembly front side 102. The individual speaker diaphragms (best seen in FIG. 6) are mounted on the linear speaker assembly front side 102. The additional elements of the speaker assemblies will best be shown in FIGS. 2 and 3.

Element 55 represents a power supply as well and includes means to input an audio signal from any source. The input elements (not shown) are of a receiving type, well known in the art. From the power supply 55 means are provided to supply power and signal to the speakers located in all three modules (100, 110, & 120) as well as any other speakers which may be located in a generally linear relation to the three modules (100, 110 & 120). The arrangement of speakers and number of modules is not intended to be limited to that shown in the Figures of this application. There may be more or less than three modules, and there may be a greater or lesser number of speakers located intermediate the modules. The Figures show the linear arrangement of the speakers and modules in a horizontal state. This is not intended to be limiting. The scope of this disclosure includes vertical linear arrangements as well as angular linear arrangements. The aesthetic linear speaker assembly 10, including drivers 13, throats 12, horns 11, inner phase plug 245 and outer phase plug 280 may be in any angular arrangement as long as the elements of the linear speaker assembly remain adjacent. As such, power supply 55 and audio input will need to be connected to these modules and individual speakers. This is generally performed by electrically conductive wiring which is well known in the audio art; however other techniques may be employed such as wireless. Different regions of the globe have different standards for electrical output. The instant device may be adapted to European, Asian or American standards for electrical appliances or devices.

The linear speaker assembly mounting means 90 supports the linear speaker assembly's right module 100, central module 110 and left module 120 proximal the top side wall 70. The linear speaker assembly mounting means 90 includes means to support the three speaker modules 100, 110, and 120.

An upper partition wall 130 is disposed intermediate the front side wall 30 and the left side wall 40. The upper partition wall 130 is proximal the top side wall 70. The upper partition wall 130 does not extend the entire vertical length of the right side wall 50 and the left side wall 40. The vertical length of the upper partition wall is generally about the vertical length of the largest of the speakers which form the linear speaker assembly 10 and such a dimension may be best observed in FIG. 6.

The linear speaker assembly right module 100 and left module 120 are generally rectangular. The front of the right module 100 and the front of the left module 120 is the linear speaker assembly module front side 102. The back of the right module 100 and the back of the left module 120 is the upper partition wall 130. The upper partition wall 130 and the linear speaker assembly module front side 102 are of generally the same horizontal and vertical dimension.

The right module is further defined by the right side wall 50 and the right module left sidewall 140. The right module 100 is additionally defined by the right module top sidewall 160. The right module 100 also includes a right module bottom sidewall (not shown). The right module bottom sidewall is parallel to and generally dimensionally the same as the right module top sidewall 160.

The left module is further defined by the left sidewall 40 and the left module right sidewall 150. The left module 120 is additionally defined by the left module top sidewall 170. The left module 120 also includes a left module bottom sidewall (not shown). The left module bottom sidewall is parallel to and generally dimensionally the same as the left module top sidewall 170.

Figure 6:
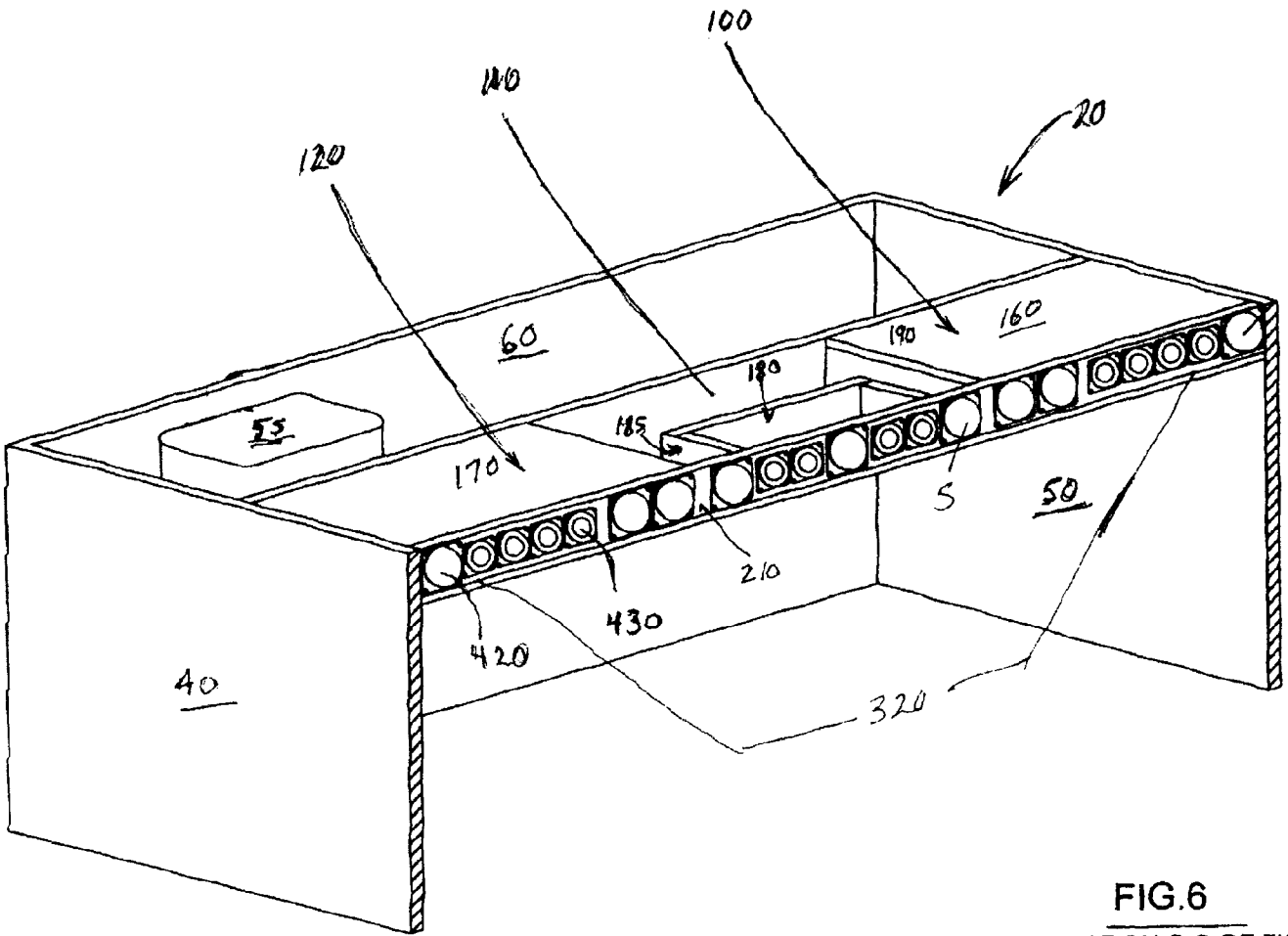
FIG. 6 is a cutaway view taken along line C-C of FIG. 1.

The speaker assembly right module 100 and the speaker assembly left module 120 are generally dimensionally equivalent and both modules support 7 (seven) individual speakers in linear relation, these speakers are best seen in FIG. 6. The arrangement of the speakers on the right module 100 and the left module 120 are the same in this embodiment, however, the arrangement, number and type of speaker located on right module 100 and left module 120 may be chosen to be other than is shown in the Figures.

The linear speaker assembly central module 110 is also rectangular and is defined by the speaker assembly module front side 102 and the speaker assembly central module rear wall 180. The central module 110 is further defined by a central module right wall 190 and a central module left wall 185. The speaker assembly module front side 102 and the central module rear wall 190 are parallel. Additionally, the central module right wall 190 is parallel to the central module left wall 185. The central module includes an upper sidewall (not shown). The central module bottom sidewall (not shown) is parallel to the central module top sidewall (not shown) which in turn is parallel to the generic piece of furniture top side wall 70. The central module top sidewall lies atop the central module rear wall 180, the central module right wall 190, the central module left wall 185 and the speaker assembly module front side 102. This central module top sidewall (not shown) is dimensioned such to be equivalent in size to the speaker assembly right module top sidewall 160 and to the speaker assembly left module top sidewall 170.

The central module 110 support 7 (seven) individual speakers in linear relation, these speakers are best seen in FIG. 6. An arrangement of the speakers on the central module 110 is also best seen in FIG. 6, however, the arrangement, number and type of speaker located on the central module 110 may be chosen to be other than is shown in the Figures.

The speaker assembly right module 100, central module 110 and left module 120 each have 7 individual speakers located in linear relation with each other. This gives 21 (twenty-one) speakers in side by side relation which are mounted in a generic piece of furniture 20 in such a fashion that the speaker, speaker driver 13, speaker throat 12 and speaker horn 11 are hidden or camouflaged in the furniture 20.

Figure 2:
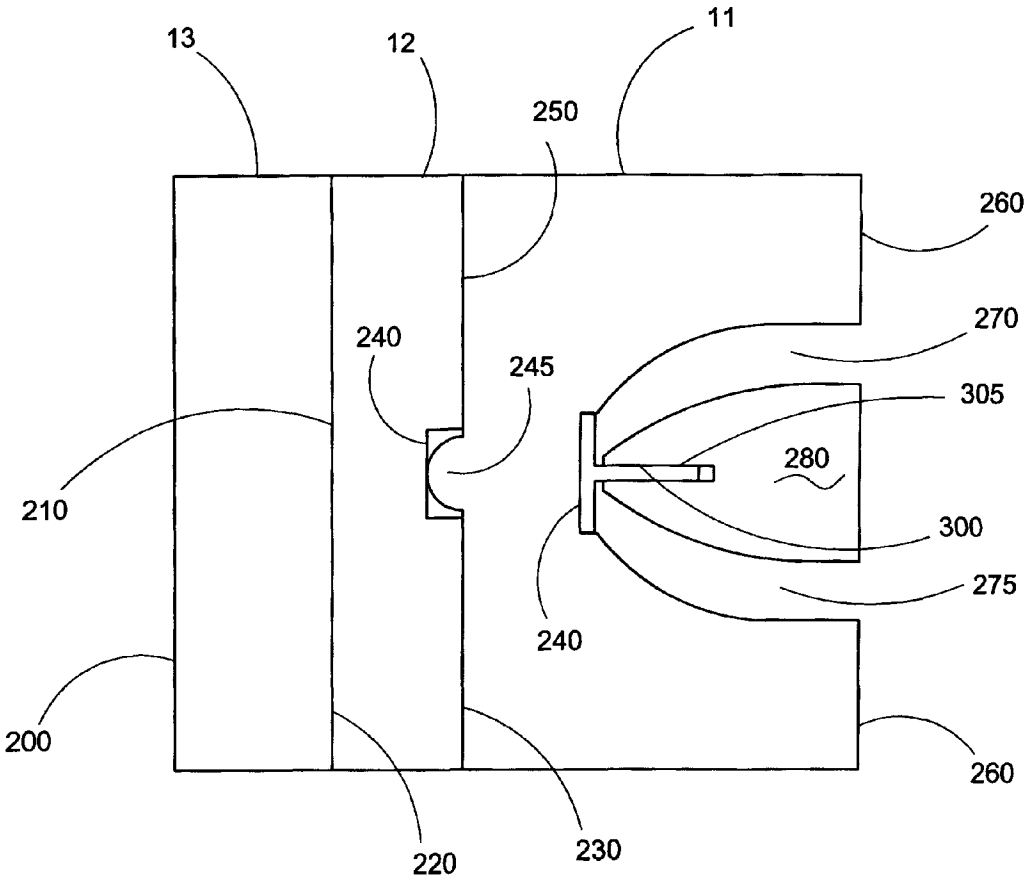
FIG. 2 is a cutaway view taken along line A-A of FIG. 1.

In front of, or coinciding with the 21 speakers which are mounted side by side, are several components including a driver portion 13, a throat portion 12 and a horn portion 11 which is best shown in FIG. 2. The driver portion 13 has a driver portion inner side 200 and a driver portion outer side 210. The throat portion 12 includes a throat portion inner side 220 and a throat portion outer side 230. A rectangular cutout 240 is provided about the center of the throat portion outer side 230. An inner phase plug 245 is received in the rectangular cutout 240. The horn portion 11 includes a horn portion inner side 250 and a horn portion outer side 260.

Additionally, horn portion 11 includes an upper curved airway 270 and a lower curved airway 275. Intermediate the upper curved airway 270 and the lower curved airway 275 is an outer phase plug 280. The outer phase plug 280 is affixed to the horn portion 11 by a T-shaped mounting element 290. The male portion 300 of the T-shaped mounting element 290 is received in a slot 305 provided in the outer phase plug 280.

As can be seen in FIG. 2, the driver portion outer side 210 is affixed adjacent the throat portion inner side 220. Additionally, the throat portion outer side 230 is affixed adjacent the horn portion inner side 250. Further, at the junction of the throat portion inner side 250 and the throat portion outer side 230, includes a centrally disposed rectangular cutout 240 which receives an inner phase plug 245.

Figure 4:
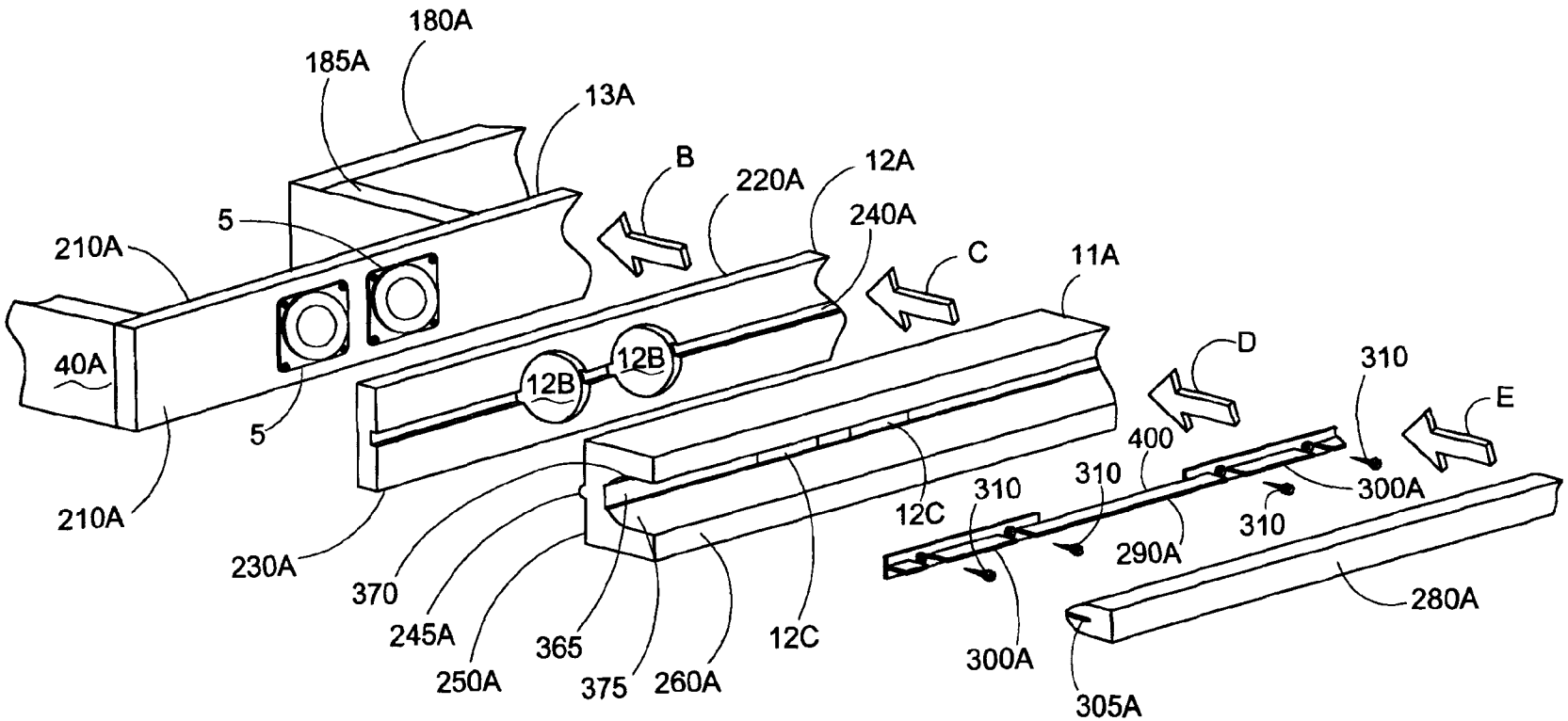
FIG. 4 is a partial front view of an embodiment of the invention detailing the inter-relationship of the speaker assembly components.
Figure 5:
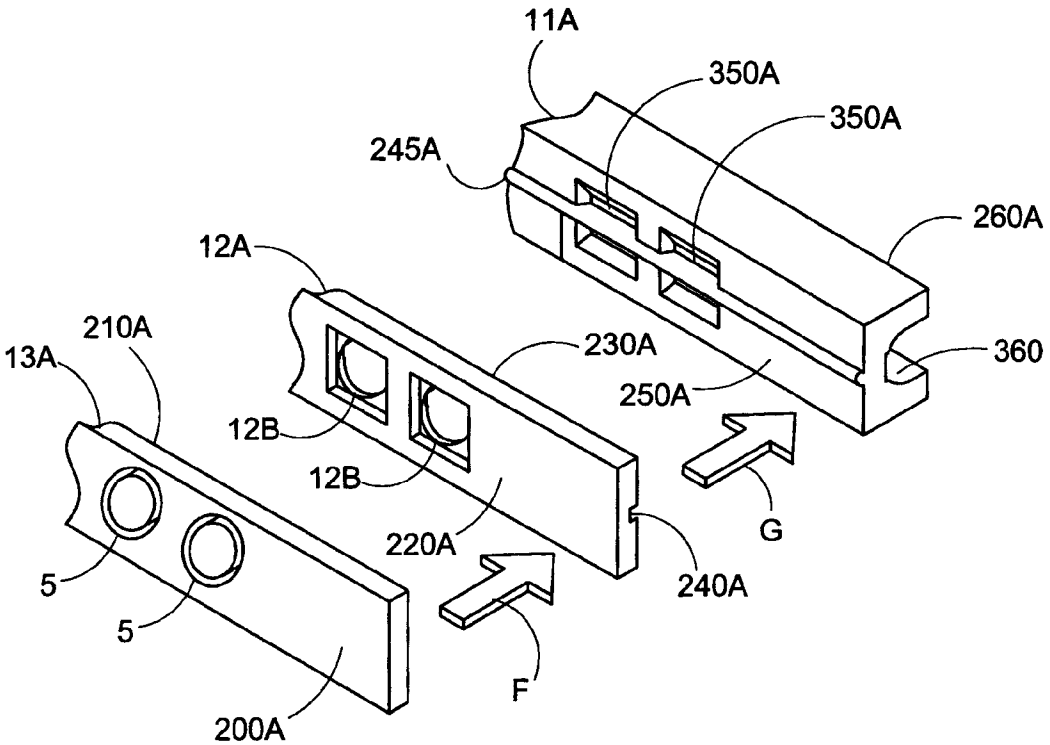
FIG. 5 is a partial rear view of an embodiment detailing the inter-relationship of the speaker assembly components.

FIG. 2 is a cutaway view taken along line A-A of FIG. 1, showing cutaway portions of driver elements 13, throat elements 12 and horn elements 11. The specific structural elements along the lateral portions of these and other components of the linear speaker assembly 10 will be addressed in the discussion of FIGS. 4 and 5. In FIGS. 4 and 5 the specific air pathway on which sound will propagate will be shown and described.

Figure 3:
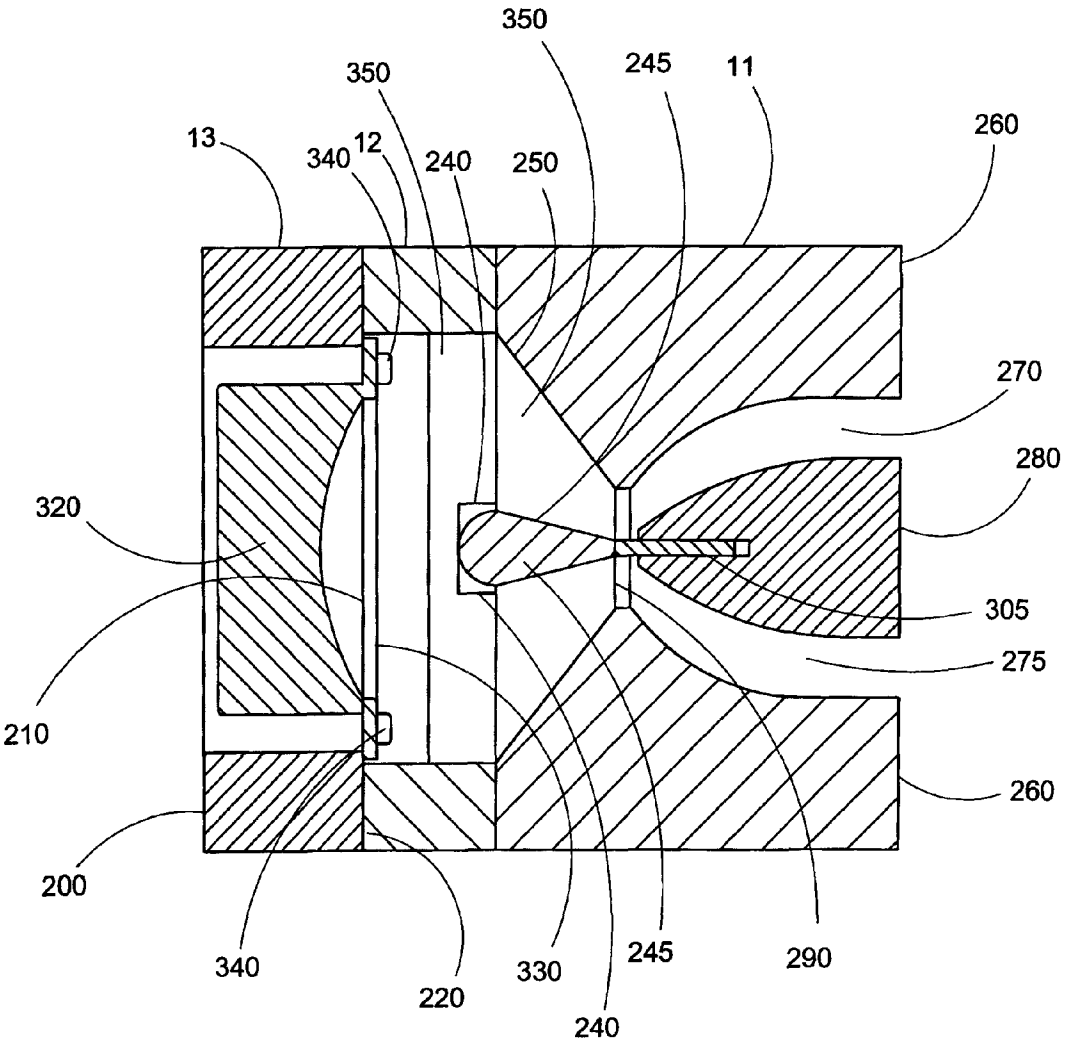
FIG. 3 is a cutaway view taken along line B-B of FIG. 1.

Referring specifically to FIG. 3 a cutaway view taken along line B-B of FIG. 1 is shown. Speaker 320 and associated diaphragm 330 are situated in the driver 13. This may be a typical speaker which includes a heavy permanent magnet and a supporting structure. This typical speaker is secured to the driver by mechanical fasteners 340 including, but not limited to, screws, studs, rivets or the like.

The driver portion inner side 200 is the element which nests or is affixed to any of the moldings, frames, television housings, computer screen housings, radios, linear handles, cabinets and any and all other types of furniture which is being employed. Then the driver portion outer side 210 is affixed adjacent the throat portion inner side 220. Additionally, the throat portion outer side 230 is affixed adjacent the horn portion inner side 250. Further, at the junction of the throat portion inner side 250 and the throat portion outer side 230, includes a centrally disposed rectangular cutout 240 which receives an inner phase plug 245. The throat 12 has this rectangular cutout 240 along the entire length of the series of speakers 320. The horn portion inner side 250 includes an air chamber 350. The air chamber 350 in this embodiment is generally trapezoidal and is the area that is cut out about the center of the horn portion inner side 250 which also covers the entire length of the series of speakers 320. The air chamber 350 abuts the outer phase plug 280, and the inner phase plug 245 is centrally disposed generally within. The distal end of the inner phase plug 245 resides in the rectangular cutout 240. The proximal end of the inner phase plug 245 may be integral with the T-shaped mounting element 290. It further may be described as the male portion of the T-shaped mounting element 300.

The outer phase plug 280 is shaped in such a fashion, that when mounted on the T-shaped mounting element 290 located on the horn 11 it forms an upper curved airway 270 and a lower curved airway 275. These two airways (270, 275) are in communication with the air chamber 350 and terminate at the horn portion outer side 260. In an important feature of this invention, the outer phase plug 280 acts as camouflage for the rearwardly disposed speakers 320. Additionally, the outer phase plug 280 may be shaped in such a fashion to complement the furniture or portion of furniture in which the linear speaker assembly 10 is located. In addition to the outer phase plug 290 complementing the furniture, the horn portion outer side 260, upper curved airway 270 and lower curved airway 275 are also located proximal to the outer wall of the furniture to which the linear speaker assembly 10 is mounted. These elements form the camouflage which reduces the visible impact of the linear tract of speakers to an observer.

The specific structural elements along the lateral portions of these and other components of the linear speaker assembly 10 will be addressed in the discussion of FIGS. 4 and 5. In FIGS. 4 and 5 the specific air pathway on which sound will propagate will be shown and described.

FIGS. 4 and 5 are illustrative of the conceptual arrangement of a pair of speakers in side by side relation with their associated drivers, throats, horns, and other elements shown.

Referring specifically to FIG. 4 a partial front view of an embodiment of the invention detailing the inter-relationship of the speaker assembly components is shown. A pair of individual speakers 5 are shown side by side in linear arrangement mounted on driver 13A. A portion of the left side wall 40A is shown. Additionally, a speaker assembly generic module left sidewall 185A is shown attached to a speaker assembly generic module rear sidewall 180A. Driver 13A has a driver portion inner side 200A and a driver portion 210A.

Throat 12A is attached to driver 13A generally indicated by arrow B. Throat 12A has a throat portion inner side 220A and a throat portion outer side 230A. A rectangular cutout 240A is centrally disposed on the throat portion outer side 230A. The rectangular cutout 240A extends the length of the throat 12A. Two individual throat elements 12B are shown. In this specific embodiment the individual throat elements 12B are circular. The individual throat elements 12B are in communication with pair of individual speakers 5. In a general case there is a one to one correspondence between an individual throat element 12B and speaker 5. This one to one arrangement of speakers to throats would be the same for a module of speakers (previously described), a group of speakers, a pair of speakers, or a single speaker, such speakers being in a linear side by side physical relation.

Horn 11A includes a horn portion inner side 250A and horn portion outer side 260A. On the horn portion inner side 250A includes a centrally disposed inner phase plug 245A. The centrally disposed inner phase plug 245A traverses generally the entire length of the horn portion inner side 250A. Horn 11A is attached to throat 12A as generally indicated by arrow C. When the horn 11A is connected to throat 12A the centrally disposed inner phase plug 245A located on thorn portion inner side 250A is received in the centrally disposed rectangular cutout 240A located on the throat portion outer side 230A.

The horn portion outer side 260A has a C-shaped cutout 360 with a flat back 365. Both the C-shaped cutout 360 and the associated flat back 365 traverse generally the entire length of the horn 11A. The flat back 365 has a pair of apertures 12C. The pair of apertures 12C are in communication with the pair of individual throats 12B and in turn are in communication with the pair of speakers 5. This is a key relationship, speaker 5, throat 12B, aperture 12C, and this relationship holds true for any number of single speakers, pairs of speakers, groups of speakers or modules of speakers.

Located on the C-shaped cutout 360 is an upper curved portion 370 and a lower curved portion 375. The upper curved portion 370 and the lower curved portion 375 define the outer perimeter of an upper curved airway 270A (not shown, but equivalent to upper curved airway 270 of FIG. 2) and a lower curved airway 275A (not shown, but equivalent to lower curved airway 275 of FIG. 2) which will be formed when the outer phase plug 280A is affixed. The upper curved airway 270A and lower curved airway 275A are in communication with apertures 12C, throat elements 12B and a pair of speaker 5 which form a path through which sound emitted will travel in this arrangement of exemplary speakers. This will be described in greater detail below.

The flat back 365 receives the T-shaped mounting element 290A as generally indicated by arrow D. The T-shaped mounting element 290A is secured to the flat back 365 by additional mechanical fasteners designated as element 310.

Outer phase plug 280A has a centrally disposed slot which will interfit with the T-shaped mounting element 290A by receiving the male portion of the T-shaped mounting element 300A as generally indicated by arrow E.

Referring back to the T-shaped mounting element 290A, there is shown a region 400, which is a portion of the T-shaped mounting element 290A which includes only the male portion of the T-shaped mounting element 300A. This region 400 is part of the sound pathway.

Outer phase plug 280A and the outer horn portion 260A are the elements of the linear speaker assembly which would be generally visible to an observer. These elements, the outer phase plug 280A and the outer horn portion 260A would form part of the exterior of a molding, frame, television housing, computer screen housing, a radio, certain linear handles, a cabinet or article of furniture in which the linear speaker system is disposed in. In this fashion, the speakers are hidden from view; however, the sound from the speakers may be listened to and enjoyed.

Referring now specifically to FIG. 5 a partial rear view of the embodiment shown in FIG. 4 detailing the inter-relationship of the speaker assembly components is shown. Again, a pair of speakers 5 are shown mounted in the driver 13A. The driver portion inner side 200A would be attached in a fashion known in the art to a molding, frame, television housing, computer screen housing, a radio, linear handles, a cabinet or article of furniture in which the linear speaker system is disposed in. The driver outer side 210A would be attached to the throat portion inner side 220A. A pair of individual throat elements 12B are aligned with the pair of speakers 5 and attached thereto along the general line of arrow F. Element 12A is the throat and disposed centrally on the throat portion outer side is an elongated rectangular cutout 240A. The throat portion outer side 230A is affixed to the horn portion inner side 250A along the general line of arrow G. A centrally disposed inner phase plug 245A is received within the centrally disposed rectangular cutout 240A located on the throat portion outer side 230A. Surrounding the inner phase plug 245A at two locations is the air chamber 350A. Note how the speakers 5 align with the throats 12B, and then further communicate with the air chamber 350A. The C-shaped cutout 360 is shown cutting into the horn portion outer side 260A. In this Figure, the outer phase plug 280A is not shown.

Referring now specifically to FIG. 6 a cutaway view taken along line C-C of FIG. 1 is shown. The generic piece of furniture 20 is shown and from this view, the generic piece of furniture left side wall 40, right wall 50 and rear wall 60 may be seen. The three speaker modules are also shown in cutaway, linear speaker assembly right module 100, central module 110 and left module 120. The right module 100 has 7 (seven) speakers in side by side relation, the central module has 7 (seven) speakers in side by side relation, and the left module has 7 (seven) speakers in side by side relation. This gives 21 (twenty-one) speakers in linear relation, extending from the right side wall 50 to the left side wall 40. In this embodiment of the invention, the number of speakers per module was chosen to be seven and the number of modules was chosen to be three. The number of speakers per module and number of modules shown in this Figure is not intended to be limiting. The speakers are mounted on the driver portion outer side 210 by conventional means.

Additionally, speaker types may vary within the linear arrangement of speakers. FIG. 6 shows a first type of speaker 420 and a second type of speaker 430. The types of speakers may be chosen to be, but in no way are limited to, a Tang Band W2-1625SA 2" Neodymium Subwoofer, a HiVi TN Fabric Dome Tweeter, Model Tn25, and Tang Band W1-1070SE 1" Full Range Driver. For clarity, it is to be understood that any type of speaker may be employed in the instant invention. Additionally, any number of single speakers, pair of speakers, other groups of different number of speakers, single modules of speakers, multiple modules of speakers and such may be employed as long as they are in generally linear relation to one another.

The speaker assembly right module top sidewall 160 and the speaker assembly left module 170 are shown atop their respective modules. The speaker assembly central module top sidewall is not shown, which permits the central module rear wall 180, the central module left wall 185 and the central module right wall 190 to be located.

A power supply 55 is shown proximal the generic piece of furniture rear side wall 60. Element 55 further includes means to input an audio signal from any source. The input elements (not shown) are of a receiving type, well known in the art. From the power supply 55 means are provided to supply power and signal to the speakers located in all three modules (100, 110, & 120).

FIG. 6 is provided to show the plurality of speakers 320, in both side by side and linear relation. The plurality of speakers 320 traverses the article it is mounted in (such as furniture) as does the driver 13, throat 12, inner phase plug 245, horn 11, upper airway 270, lower airway 275, and outer phase plug 280. The inner phase plug 245, horn 11 and outer phase plug 280 all traverse the article the assembly is mounted (such as furniture) in such a fashion that the plurality of speakers 320 share a common inner phase plug 245, horn 11, upper airway 270, lower airway 275, and outer phase plug 280. This linear speaker assembly 10 is best shown in FIG. 1, but by the obscuring elements intermediate the outer phase plug 280 and the plurality of speakers 320, it becomes camouflaged to the casual observer. The arrangement of the above elements which comprise the linear speaker assembly produces a realistic sound.

LIST OF NUMERICAL DESIGNATIONS OF ELEMENTS SHOWN IN FIGURES individual speaker 5
aesthetic linear speaker assembly 10
generic piece of furniture 20
generic piece of furniture front sidewall 30
generic piece of furniture front sidewall upper portion 35
generic piece of furniture left sidewall 40
generic piece of furniture right sidewall 50
generic piece of furniture rear sidewall 60
generic piece of furniture top sidewall 70
generic piece of furniture bottom sidewall 80
linear speaker assembly mounting means 90
speaker assembly right module 100
speaker assembly module front side 102
speaker assembly central module 110
speaker assembly left module 120
upper partition wall 130
speaker assembly right module left sidewall 140
speaker assembly left module right sidewall 150
speaker assembly right module top sidewall 160
speaker assembly left module top sidewall 170
speaker assembly right module bottom sidewall (not shown)
speaker assembly left module bottom sidewall (not shown)
speaker assembly central module rear wall 180
speaker assembly central module left wall 185
speaker assembly central module right wall 190
speaker assembly central module bottom sidewall (not shown)
driver 13
throat 12
horn 11
power supply and inputs for speakers 55
driver portion inner side 200
driver portion outer side 210
throat portion inner side 220
throat portion outer side 230
rectangular cutout 240
inner phase plug 245
horn portion inner side 250
horn portion outer side 260
upper curved airway 270
lower curved airway 275
outer phase plug 280
T-shaped mounting element 290
male portion of T-shaped mounting element 300
slot 305
speaker 320
diaphragm 330
mechanical fasteners 340
air chamber 350

RELEVANT TO FIGS. 4 & 5 driver 13A
throat 12A
horn 11A
individual speaker 5
left side wall 40A
speaker assembly generic module left sidewall 185A
speaker assembly generic module rear sidewall 180A
driver portion inner side 200A
driver portion outer side 210A
Arrow B B
throat portion inner side 220A
throat portion outer side 230A
rectangular cutout 240A
individual throat 12B
horn portion inner side 250A
horn portion outer side 260A
centrally disposed inner phase plug 245A
arrow C C
C-shaped cutout 360
flat back 365
apertures 12C
outer elongated phase plug 280A upper curved airway 275A (not shown)*
*equivalent to element 275 in FIG. 2
lower curved airway 280A (not shown)*
*equivalent to element 280 in FIG. 2
T-shaped mounting element 290A
male portion of the T-shaped mounting element 300A
slot 305A
arrow D D
mechanical fasteners 310
arrow E E
portion of T-shaped mounting element which is solely the male portion 400
arrow F F
air chamber 350A
first type of speaker 420
second type of speaker 430

What is claimed is:

1. A linear loudspeaker assembly to be placed horizontally in an item of furniture comprising:

an elongated speaker mounting element, said elongated speaker mounting element having a first length, said elongated speaker mounting element having a first number of speakers mounted thereon, a driver unit, said driver unit having a first side, a second side, and said first length, said second side having a centrally disposed (rectangular) horizontal slot provided along said first length, said driver unit having a first number of drivers provided thereon, said first side of said driver unit placed adjacent to said first number of speakers, a first elongated phase plug, said first phase plug having said first length and said first elongated phase plug received in said centrally disposed slot, an elongated throat, said elongated throat having a throat first side, a throat second side, and said first length, said throat first side placed adjacent said driver unit said second side, an elongated horizontal horn, said elongated horn having a horn first side, a horn second side, and said first length, said horn second side having a centrally disposed parabolic slot provided along said first length, said parabolic slot extending substantially from said horn second side to said horn first side where said parabolic slot terminates at said throat second side, forming a base, an elongated T-shaped mounting element having said first length, said T-shaped mounting element having a male portion, and a base portion, said T-shaped mounting element base portion disposed on said base, said male portion being perpendicular to said elongated throat, a second elongated phase plug, said second elongated phase plug having a second elongated phase plug first side, a second phase plug second side and said first length, said second elongated phase plug first side having a second phase plug slot extending said first length, said second horizontal phase plug slot inter-engaging said elongated T-shaped mounting element male portion, forming an upper curved airway and a lower curved airway, said upper curved airway and said lower curved airway both having said first length, whereby;

said first number of speakers emit sound which is propagated through said linear loudspeaker assembly, and specifically through said upper curved airway and said lower curved airway, and whereby said second elongated phase plug camouflages said first number of speakers in such a fashion that said item of furniture in not seen as a platform for said linear loudspeaker assembly.

2. A linear speaker assembly for an article of furniture comprising, a plurality of speakers, said speakers being disposed in said article of furniture in a side by side relation for a first length, an elongated element including a plurality of throats, said plurality of throats generally formed of apertures aligned with said plurality of said speakers, an elongated horn, said elongated horn having said first length, an outer elongated phase plug having said first length, said outer elongated phase plug being received within said elongated horn, forming an elongated sound pathway, whereby a sound generated from said plurality of speakers passes through said plurality of apertures, and said sound then passes through said elongated horn along said first length, and further said sound passes through said elongated sound pathway.

3. A linear speaker assembly for an article of furniture as claimed in claim 2 wherein said elongated phase plug further forms an upper sound pathway and a lower sound pathway.

4. A linear speaker assembly for an article of furniture as claimed in claim 3 wherein said elongated element having a plurality of throats includes an inner side and an outer side, said inner side being disposed proximal to said plurality of speakers.

5. A linear speaker assembly for an article of furniture as claimed in claim 4 wherein said elongated element having a plurality of throats outer side includes a centrally disposed rectangular cutout thereon.

6. A linear speaker assembly for an article of furniture as claimed in claim 5 including an inner phase plug, said inner phase plug having said first length.

7. A linear speaker assembly for an article of furniture as claimed in claim 6 wherein said inner phase plug is disposed within said centrally disposed rectangular cutout.

8. A linear speaker assembly for an article of furniture as claimed in claim 7 where said elongated horn has an inner side and an outer side.

9. A linear speaker assembly for an article of furniture as claimed in claim 8 wherein said elongated horn inner side abuts said elongated element having a plurality of throats said outer side.

10. A linear speaker assembly for an article of furniture as claimed in claim 9 wherein said elongated horn outer side includes a C-shaped cutout substantially along said first length, said C- shaped cutout having a center, said center receiving an outer phase plug mounting means.

11. A linear speaker assembly for an article of furniture as claimed in claim 10 wherein said outer phase plug includes a slot, said slot is interfitted with said phase plug mounting means, forming an upper curved airway and a lower curved airway.

12. A linear speaker assembly for an article of furniture as claimed in claim 11 wherein said upper curved airway is defined by a top side of said C-shaped cutout and a top portion of said outer phase plug.

13. A linear speaker assembly for an article of furniture as claimed in claim 12 wherein said lower curved airway is defined by a lower side of said C-shaped cutout and a bottom portion of said outer phase plug.

14. A linear speaker assembly for an article of furniture as claimed in claim 13 wherein said outer phase plug and said elongated horn outer side are arranged in such a manner whereby said plurality of speakers forming said linear speaker assembly is substantially camouflaged or not visible to a casual observer.

* * * * *